US007370492B2

(12) United States Patent
Hoare et al.

(10) Patent No.: US 7,370,492 B2
(45) Date of Patent: May 13, 2008

(54) CHILLER

(75) Inventors: Richard Hoare, Botany (AU); David Davenport, Botany (AU)

(73) Assignee: Breville Pty Limited, Botony, NSW (AU)

( * ) Notice: Subject to any disclaimer, the term of this patent is extended or adjusted under 35 U.S.C. 154(b) by 200 days.

(21) Appl. No.: 10/562,034

(22) PCT Filed: Apr. 8, 2004

(86) PCT No.: PCT/AU2004/000457

§ 371 (c)(1),
(2), (4) Date: Dec. 22, 2005

(87) PCT Pub. No.: WO2005/003655

PCT Pub. Date: Jan. 13, 2005

(65) Prior Publication Data

US 2007/0017246 A1 Jan. 25, 2007

(30) Foreign Application Priority Data

Jul. 2, 2003 (AU) ..... 2003903368

(51) Int. Cl.
*F25D 3/08* (2006.01)

(52) U.S. Cl. ..... 62/457.8

(58) Field of Classification Search ..... 62/371, 62/457.2, 457.4, 457.8, 530, 457.9
See application file for complete search history.

(56) References Cited

U.S. PATENT DOCUMENTS 4,711,099 A * 12/1987 Polan et al. ..... 62/457.4
4,768,354 A * 9/1988 Barnwell ..... 62/457.4
6,082,114 A * 7/2000 Leonoff ..... 62/3.64
6,353,251 B1 * 3/2002 Kimura ..... 257/473

* cited by examiner

*Primary Examiner*—Melvin Jones
(74) *Attorney, Agent, or Firm*—Molins & Co.

(57) ABSTRACT

A chiller for a container such as a wine bottle is disclosed. The chiller includes an insulated reservoir. Located within the reservoir are one or more reusable cold storage packs, known as freezer bricks. The bricks define a cooling ring that conforms to the interior of the container and define an annular gap between an exterior surface of the ring and an interior surface of the reservoir. An impeller is located at the bottom of the reservoir. The combination of ring and impeller establishes a vertical recirculation pattern that achieves rapid chilling.

19 Claims, 4 Drawing Sheets

CHILLER

FIELD OF THE INVENTION

The invention pertains to chillers and more particularly to a chiller used to chill the contents of a container, for example, a bottle or cans, using re-circulating water and freezer bricks.

BACKGROUND OF THE INVENTION

The practice of cooling individual bottles of wine in a refrigerator or in a bucket of ice is well known. In order to provide faster and more convenient chilling of individual bottles, such as wine bottles, specialized electro mechanical devices have been proposed.

One such device is depicted in U.S. Pat. No. 6,397,624 entitled 'cooling apparatus'. Depicted there is an individual bottle cooler which consists of a chamber formed from a thermally insulative material. The chamber is intended to contain a mixture of ice and water. The device relies on ice. An impeller draws water through an aperture in the bottom of the chamber and forces it out through an exit port in the annular gap between the bottle and the inner skin of the container. The exit port circulates the water around the circumference of the bottle and chamber so that the flow of water is essentially circular when seen from above.

OBJECTS AND SUMMARY OF THE INVENTION

It is an object of the present invention to provide an alternative to known bottle chilling devices. It is another object of the invention to provide an alternative which is both rapid and efficient.

Accordingly, there is provided a chiller for a container such as a wine bottle. The chiller includes an insulated reservoir. Located within the reservoir are one or more reusable cold storage packs, known as freezer bricks. The bricks define a cooling ring that conforms to the interior of the container and preferably define an annular gap between an exterior surface of the ring and an interior surface of the reservoir.

In preferred embodiments, an impeller is located at the bottom of the reservoir. The combination of ring and impeller establishes a vertical recirculation pattern that achieves rapid chilling.

In other embodiments of the invention, two or more identical packs are provided.

In yet other embodiments of the invention, the packs are formed from extruded aluminum.

BRIEF DESCRIPTION OF THE DRAWING FIGURES

BEST MODE AND OTHER EMBODIMENTS OF THE INVENTION

Figure 1:
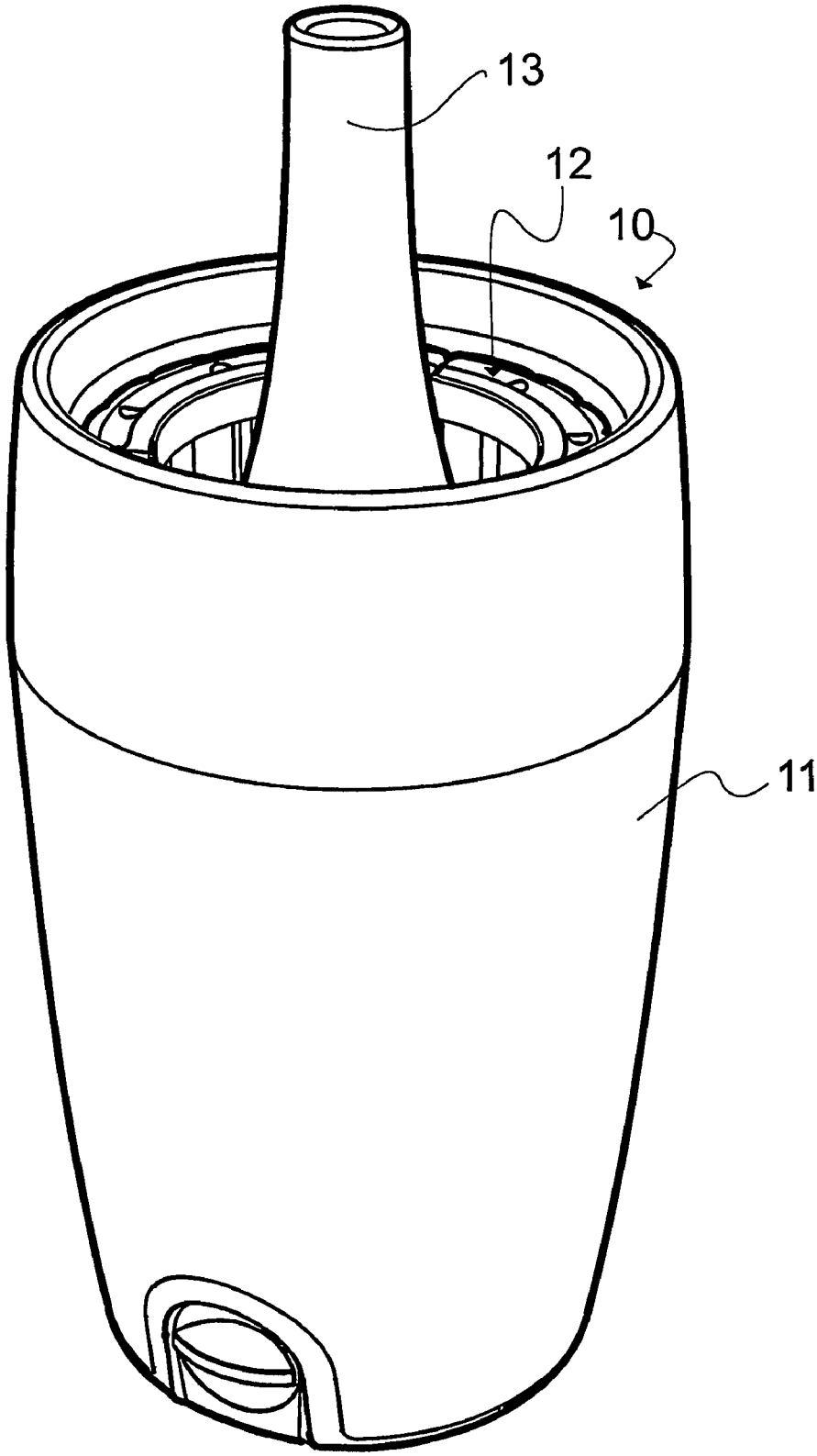
FIG. 1 is a perspective view of a bottle chiller according to the teachings of the present invention.

As shown in FIG. 1 a bottle chiller comprises an insulating housing 11 with an interior reservoir adapted to accommodate a cooling tube or ring 12 and a bottle such as a wine bottle 13. In this specification a wine bottle is used for the purpose of explaining the device but it will be understood that any bottle or can or object that can fit in the device can be chilled.

Figure 2:
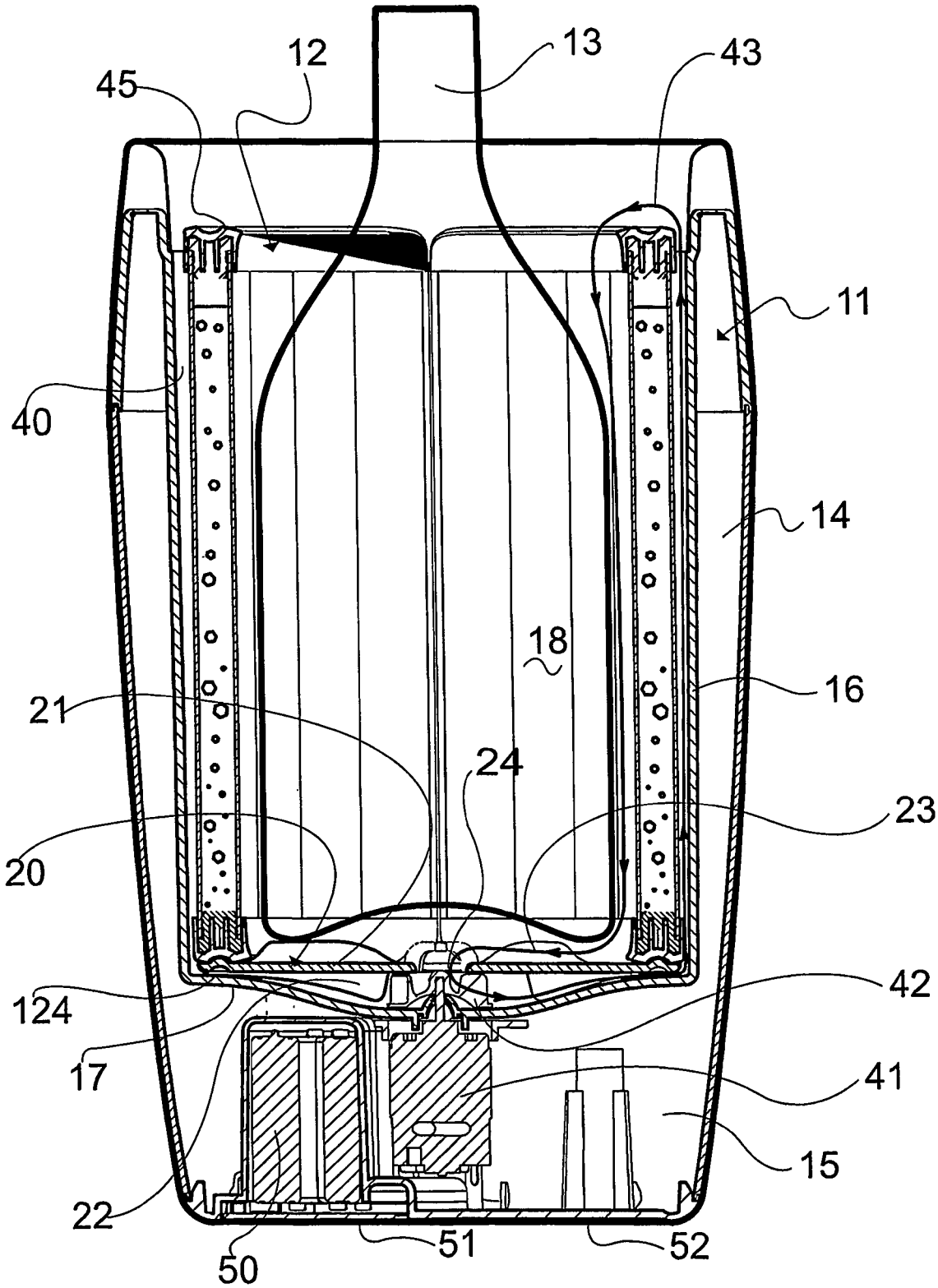
FIG. 2 is a cross sectional view of the device depicted in FIG. 1.

As shown better in FIG. 2, the housing 11 includes a body which includes air filled, foam filled or otherwise insulating side walls 14 and a bottom cavity 15 for locating electrical components and the like. The interior walls 16 of the body and upper surface 17 of the cavity 15 define the reservoir 18. The walls 16 of the reservoir are generally cylindrical and sized to accommodate the cooling ring 12 and a bottle 13 located within it.

The bottom of the reservoir supports a removable spacer 20. The spacer 20 is in the form of a platform 21 having raised fins 22, 23 formed on either side of it. The top fins support the bottle above the intake opening 24 formed in the center of the platform 21. The bottom fins are optional and assist in the support of the platform above the path of the water being accelerated by the impeller. The bottom fins may be optionally curved so as to swirl the accelerated water about a central axis of the reservoir. The platform also includes a raised locating bead 124 around its periphery. The impeller draws water from the intake and urges it toward the circumferential edge of the platform. Water is urged radially, in all directions and away from the opening 24.

Figure 3:
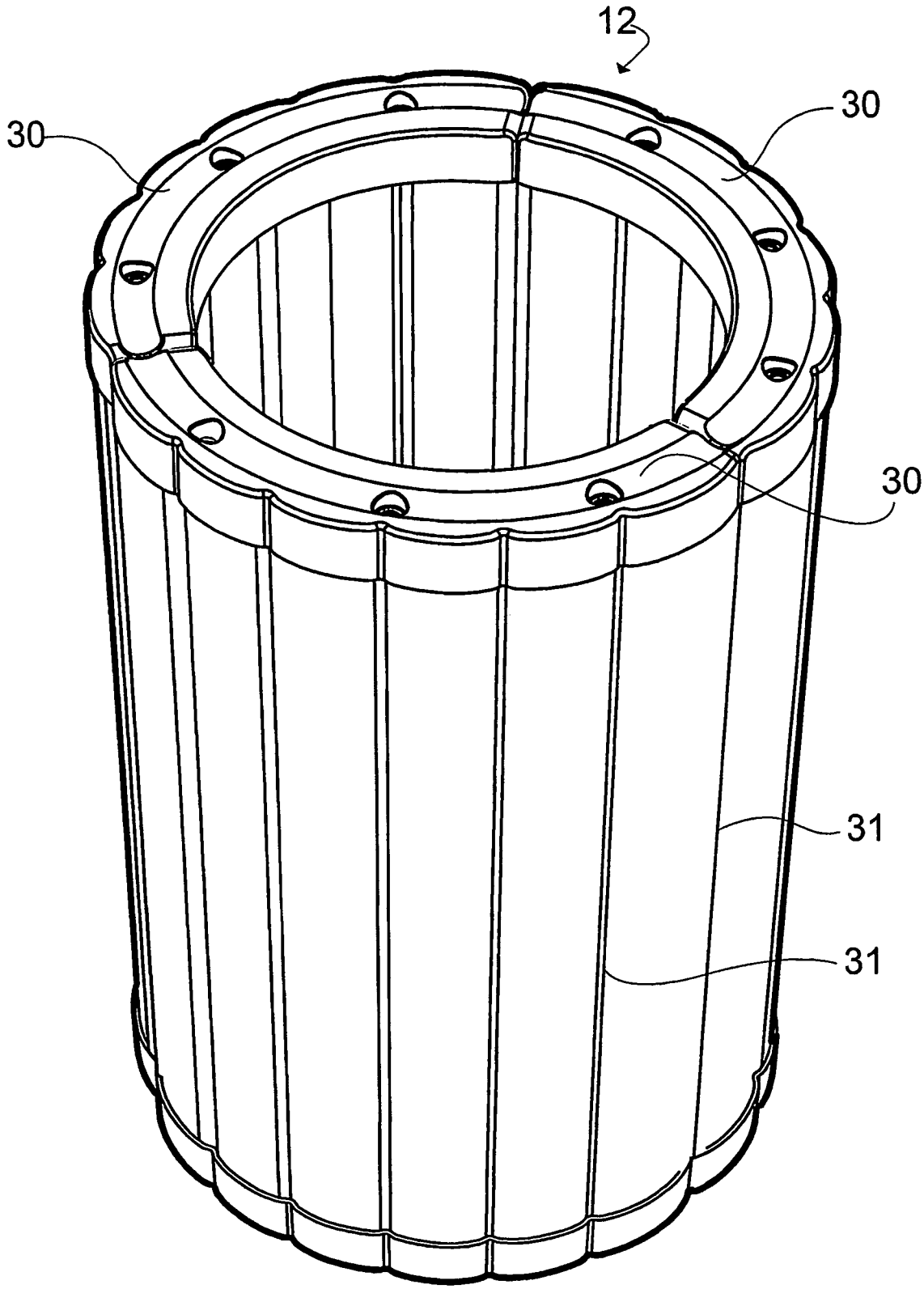
FIG. 3 is a perspective view of a cooling tube formed from 3 identical cooling packs.
Figure 4:
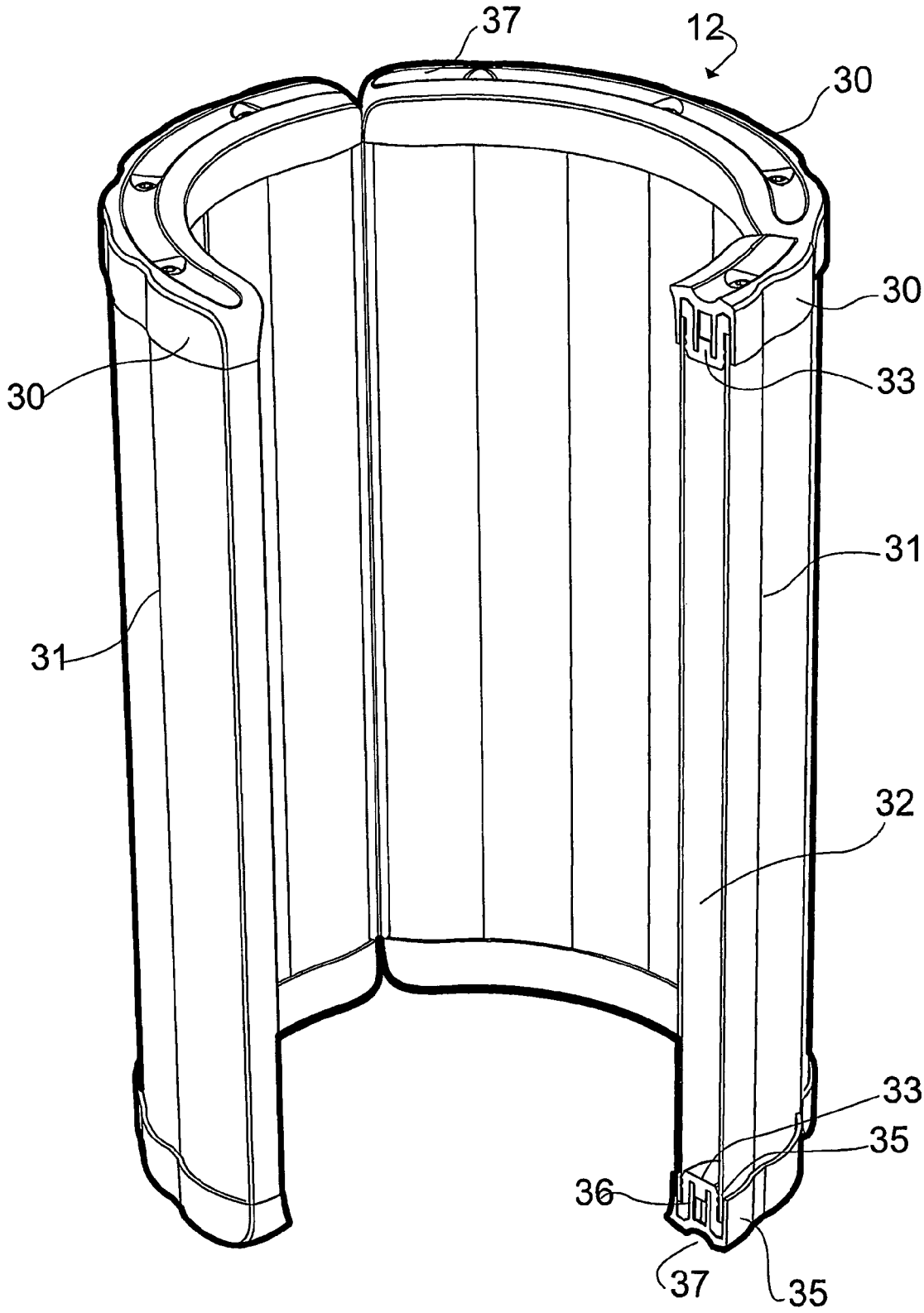
FIG. 4 is a perspective view, partially cross sectioned of a cooling tube.

As shown better in FIGS. 3 and 4, the cooling ring 12 comprises a reusable rigid structure which contains a gel, such as a polysaccharide gel. The gel can absorb heat after being cooled in a freezer. Structures made using this gel are often referred to as 'cold packs' or freezer bricks. In this example, the cooling ring 12 is formed from 3 identical shaped packs 30 which are arc shaped or curved in cross section. It will be appreciated that a single cylindrical pack may be used but that the provision of 2 or more identical packs allows the packs to be stacked conveniently in a freezer compartment without occupying excessive space. In this example, the individual packs include longitudinal corrugations 31 on both (or either) the interior and exterior surfaces. These corrugations assist in providing additional surface area and possibly enhanced laminar flow. Longitudinal ribs may also be used for this purpose.

As shown in FIG. 4, each pack 30 includes and interior space 32 which is for containing the aforesaid gel. Each pack 31 is made from an aluminum extrusion which is cut to length. Accordingly, the body portion of each brick is open ended. Each end is sealed with a polymeric seal 33 and each seal may include sealing ridges 34 for creating high surface contact pressures between the seal 33 and the interior surface of the pack.

The seals 33 are capped. Each cap 35 includes 1 or more central ribs 36 which serve to expand the seal 33 and increase the contact pressure between the seal and brick body. The caps generally conform to the external surfaces of the corrugated or ribbed bricks. The caps also include, along their top and bottom surfaces, indentations or grooves 37 which cooperate with the bead or beads 34 formed on the top of the platform 21. As shown in FIG. 2, the indentations 37 cooperate with the beads 24 to locate and stabilize the bricks and around the interior walls 16 of the device. Importantly, the positioning of the bricks creates a gap 40 between the outside surface of the cooling tube and the interior wall 16.

In preferred embodiments, an electric motor 41 is located in the chamber 15. The motor 41 drives an impeller 42 which is located between the upper surface 17 of the chamber and the platform 21. Rotation of the impeller 42 causes water to be drawn through the central opening 24 and causes the water to flow radially outwardly toward the circumferential exit opening which surrounds the platform. Accordingly, water is directed from that opening into and up the gap 40 as shown by the arrows 43. Water rising in the gap 40 is chilled by the cooling tube 12 and is eventually pumped by the impeller over the top edge 45 of the cooling tube 12. From this point it descends and enters the central part of the reservoir and makes contact with the bottle 13. Water subsequently flows down the outside of the bottle where upon it is drawn by the impeller 42 through the central opening 24. In this way, the water is seen to circulate in a vertical direction, rising through the gap 40 and descending around the outside surface of the bottle 13.

In some embodiments, the motor is driven by 1 or more batteries 50 located in the chamber 15. An access door 51 on the bottom 52 of the device allows the batteries to be inserted and withdrawn.

What is claimed is:

1. A wine chiller comprising:

an insulated reservoir;

a removable cooling ring formed from one or more removable freezer bricks; and an impeller for circulating the contents of the reservoir.

2. The wine chiller of claim 1, wherein:

an interior surface of the reservoir and an exterior surface of the cooling ring define a circumferential gap.

3. The wine chiller of claim 1, wherein:

a removable spacer is located in a lower portion of the reservoir and the impeller is below the spacer.

4. The wine chiller of claim 1, wherein:

there is a vertical gap between an upper edge of the cooling ring and an upper rim of the reservoir.

5. The wine chiller of claim 1, wherein:

the freezer bricks are two or more in number and cooperate to form the ring by locating against one another along vertical edges.

6. The wine chiller of claim 1, wherein:

the freezer bricks are identical in size.

7. The wine chiller of claim 4, wherein:

the impeller has a vertical axis of rotation and there is a circumferential gap between the spacer and an interior of the reservoir.

8. A wine chiller, comprising:

an insulated reservoir having a side wall and a lower surface;

a removable cooling ring located above the surface and within the wall;

a vertical impeller below the lower surface that is adapted to urge a fluid radially into a gap between the wall and the lower surface; and an inlet to the impeller.

9. The wine chiller of claim 8, wherein:

the impeller is in fluid communication with the gap and urges fluid into it.

10. The chiller of claim 8, wherein:

there is a vertical gap between an upper edge of the cooling ring and an upper rim of the wine cooler.

11. The chiller of claim 10, wherein:

a flow path is defined, the path passing upward over an exterior of the cooling ring, over the upper edge of the cooling ring and down toward the impeller.

12. The chiller of claim 11, wherein:

the flow path further comprises the inlet, the inlet being located centrally and above the impeller.

13. The cooling reservoir of claim 12, wherein:

the cooling ring comprises tow or more similar freezer bricks.

14. A freezer brick for use in a wine chiller comprising:

an extruded aluminium body portion having an internal cavity;

two open ends sealed with a polymeric seal;

the body portion being made from an aluminium extrusion which is curved in cross-section.

15. The freezer brick of claim 14, wherein:

the body portion has formed in it exterior longitudinal ribs.

16. The freezer brick of claim 14, further comprising:

a cap that cooperates with the seal.

17. The freezer brick of claim 14, wherein:

the cap has one or more central ribs which expand the seal and increase a contact pressure between the seal and an interior of the body portion.

18. The freezer brick of claim 14, wherein:

the cap includes indentations along the top and bottom surfaces for locating and stabilising the freezer brick when placed in registry with cooperating features within the wine chiller.

19. The freezer brick of claim 14, wherein:

the freezer bricks cooperate to form a ring by locating against one another along generally parallel, vertical edges.

* * * * *